US009180603B2

(12) United States Patent
Ascari et al.

(10) Patent No.: US 9,180,603 B2
(45) Date of Patent: Nov. 10, 2015

(54) MACHINE FOR THE PREPARATION OF PIECES OF AN OVAL OR SPHERICAL FRUIT, SUCH AS A MELON OR WATERMELON

(75) Inventors: Daniela Ascari, Cavezzo (IT); Luca Ascari, Cavezzo (IT)

(73) Assignee: A.B.L. S.R.L., Cavezzo (IT)

( * ) Notice: Subject to any disclaimer, the term of this patent is extended or adjusted under 35 U.S.C. 154(b) by 373 days.

(21) Appl. No.: 13/700,544

(22) PCT Filed: Jul. 27, 2011

(86) PCT No.: PCT/IB2011/053344

§ 371 (c)(1),
(2), (4) Date: Nov. 28, 2012

(87) PCT Pub. No.: WO2012/017356

PCT Pub. Date: Feb. 9, 2012

(65) Prior Publication Data

US 2013/0118326 A1 May 16, 2013

(30) Foreign Application Priority Data

Aug. 5, 2010 (IT) ..... MO2010A0232

(51) Int. Cl.

| | |
|---|---|
| ***B26D 5/34*** | (2006.01) |
| ***B26D 3/18*** | (2006.01) |
| ***B26D 1/09*** | (2006.01) |
| ***B26D 3/26*** | (2006.01) |

(Continued)

(52) U.S. Cl.

CPC .. *B26D 5/34* (2013.01); *B26D 1/09* (2013.01); *B26D 3/185* (2013.01); *B26D 3/26* (2013.01); *B26D 3/28* (2013.01); *B26D 5/007* (2013.01); *B26D 7/0608* (2013.01); *B26D 7/0625* (2013.01); *B26D 9/00* (2013.01); *B26D 2210/02* (2013.01); *Y10T 83/2022* (2015.04)

(58) Field of Classification Search

CPC .... B26D 2210/02; B26D 7/0608; B26D 3/26; B26D 3/185; B26D 5/34; B26D 5/007; B26D 1/09; B26D 7/0633

USPC ..... 83/932, 751, 618, 151, 109, 155.1, 365, 83/620, 23, 856, 857, 858, 367, 630; 99/536, 537, 538, 539, 540; 209/586; 30/114

See application file for complete search history.

(56) References Cited

U.S. PATENT DOCUMENTS

| | | | | |
|---|---|---|---|---|
| 13,475 A * | 8/1855 | Ketcham | ..... | 83/425.3 |
| 153,873 A * | 8/1874 | Wickes et al. | ..... | 144/39 |

(Continued)

FOREIGN PATENT DOCUMENTS

| | | | | |
|---|---|---|---|---|
| DE | 10 2004 013170 A1 | 10/2005 | | |
| EP | 1570961 A1 * | 9/2005 | ..... | B26D 7/18 |
| WO | 2008/033741 A2 | 3/2008 | | |

*Primary Examiner* — Kenneth E. Peterson
*Assistant Examiner* — Jennifer Swinney
(74) *Attorney, Agent, or Firm* — Pearne & Gordon LLP

(57) ABSTRACT

Machine for the preparation of pieces of an oval or spherical fruit, such as a melon or watermelon, comprising: a first cutting station (10), predisposed to cut a fruit (100) into round portions (101) along parallel planes; a second cutting station (20), with two or more shaped blades (21*a,b,c*) predisposed to cut the round portions (101) into prismatic fragments; a sorting device (40), predisposed to detect a diameter of the round portions (101) and to assign each round portion (101) to a shaped blade (21*a,b,c*), selected on the basis of the diameter of the round portion.

16 Claims, 5 Drawing Sheets

(51) Int. Cl.

| | |
|---|---|
| ***B26D 3/28*** | (2006.01) |
| ***B26D 5/00*** | (2006.01) |
| ***B26D 7/06*** | (2006.01) |
| ***B26D 9/00*** | (2006.01) |

(56) References Cited

U.S. PATENT DOCUMENTS

| | | | | | |
|---|---|---|---|---|---|
| 1,317,742 | A | * | 10/1919 | Von Houten | 425/300 |
| 1,361,776 | A | * | 12/1920 | Rosenfeld | 83/880 |
| 1,423,490 | A | * | 7/1922 | Vafiades et al. | 99/540 |
| 1,999,449 | A | * | 4/1935 | Erickson | 83/751 |
| 2,127,651 | A | * | 8/1938 | Panther | 83/588 |
| 2,635,662 | A | * | 4/1953 | Doering et al. | 99/550 |
| 3,572,201 | A | * | 3/1971 | Roger | 83/119 |
| 3,875,840 | A | * | 4/1975 | Moorman | 83/431 |
| 3,886,827 | A | * | 6/1975 | McCarthy | 83/56 |
| 3,929,048 | A | * | 12/1975 | McGehee | 83/751 |
| 3,955,678 | A | * | 5/1976 | Moyer | 209/564 |
| 4,320,841 | A | * | 3/1982 | Gordon et al. | 209/552 |
| 4,653,393 | A | * | 3/1987 | Ross | 99/542 |
| 4,761,291 | A | | 8/1988 | Neumann et al. | |
| 4,812,321 | A | * | 3/1989 | Vandervoort et al. | 426/503 |
| 5,161,447 | A | * | 11/1992 | Emsens | 83/751 |
| 5,253,765 | A | * | 10/1993 | Moorehead et al. | 209/539 |
| 5,979,281 | A | | 11/1999 | Caesar | |
| 7,251,537 | B1 | * | 7/2007 | Blaine et al. | 700/29 |
| 8,495,941 | B2 | | 7/2013 | Farid et al. | |
| 8,887,602 | B2 | * | 11/2014 | Weber | 83/23 |
| 2002/0056352 | A1 | * | 5/2002 | Rompa | 83/425.3 |
| 2006/0156878 | A1 | * | 7/2006 | Faires et al. | 83/13 |
| 2009/0193952 | A1 | | 8/2009 | Farid et al. | |
| 2009/0211462 | A1 | * | 8/2009 | Foxcroft | 99/543 |

* cited by examiner

MACHINE FOR THE PREPARATION OF PIECES OF AN OVAL OR SPHERICAL FRUIT, SUCH AS A MELON OR WATERMELON

The present invention relates to a machine for the preparation of pieces of an oval or spherical fruit, such as a melon or watermelon.

Currently, the cutting of watermelon or melon in pieces of small size, suitable for example to be packaged in bags or boxes for the preparation of salads or for other uses, is done mainly by hand. The operators involved, using knives, cut the fruit into slices of various shapes which are then chopped into smaller pieces.

Like all manual operations, the cutting of fruit in the manner described above is also rather slow and laborious, and usually involves a considerable waste of pulp.

The aim of the present invention is to provide a machine for the preparation of pieces of an oval or spherical fruit.

The machine according to the present invention greatly speeds up the preparation of fruit pieces, as well as greatly reduces the waste of pulp.

Additional features and advantages of the machine according to the present invention will become more apparent from the ensuing indicative, and hence non-limiting, description of a preferred but not exclusive embodiment, presented below making reference to the accompanying drawings in which.

Figure 3:
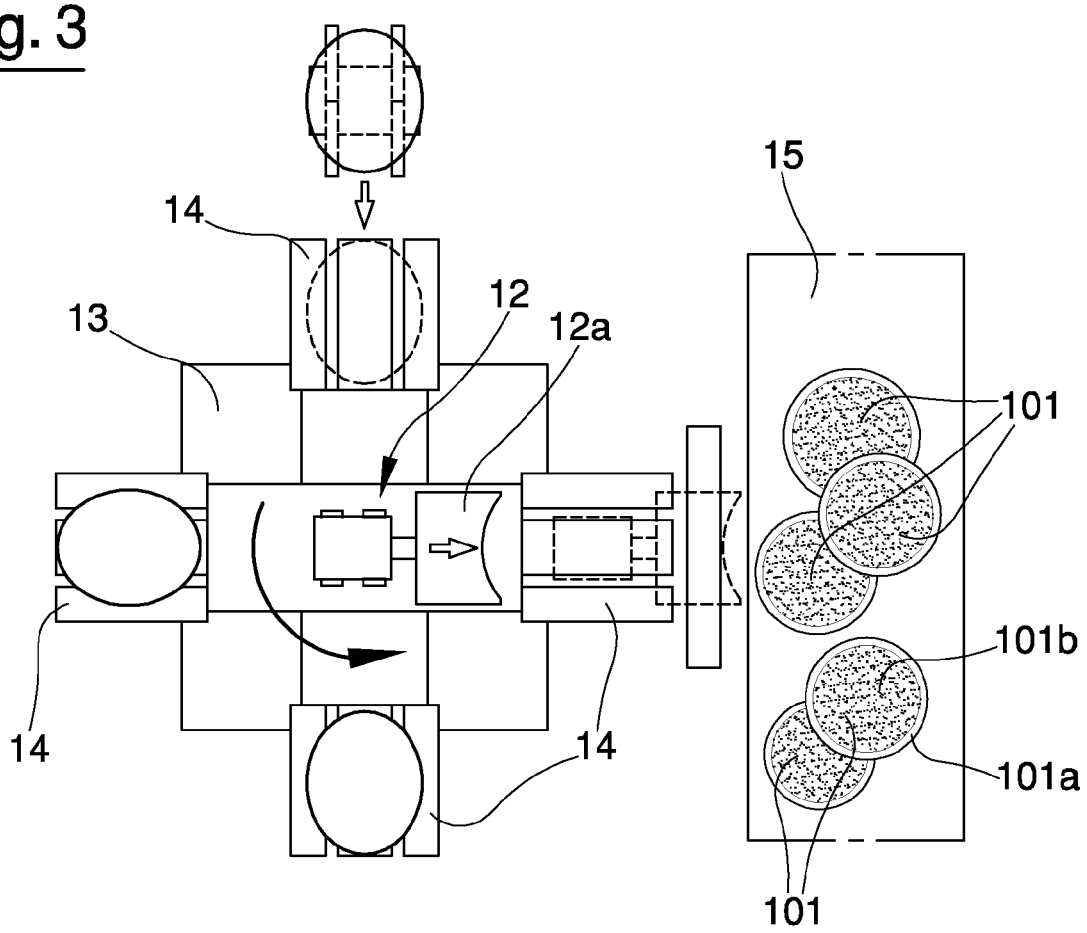
FIGS. 3 and 4 show in greater detail a first cutting station of the machine.
Figure 4:
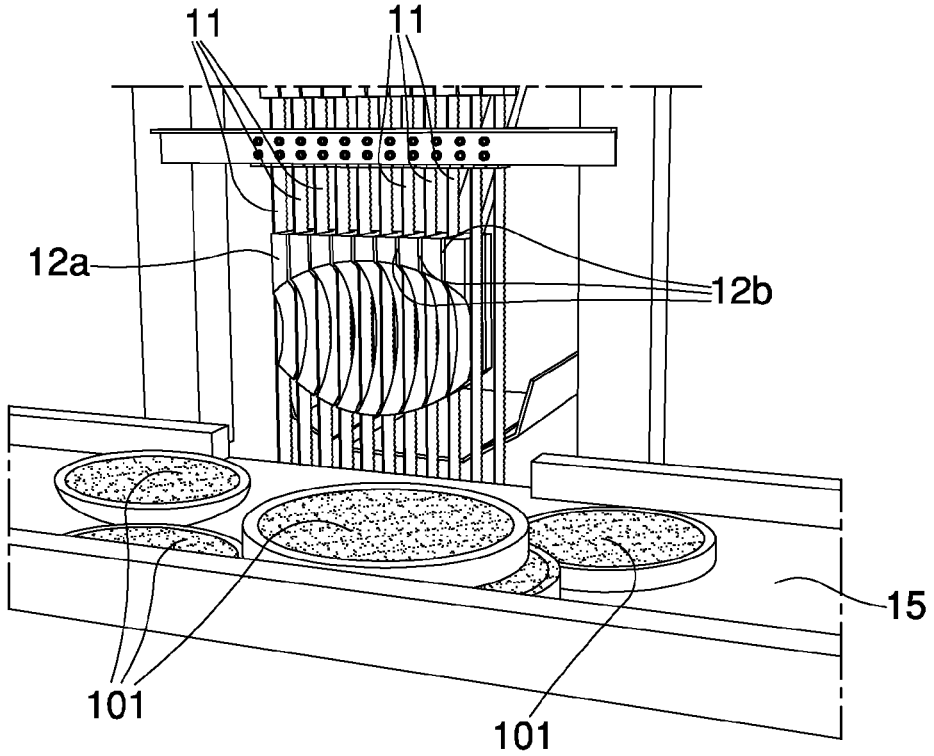

The machine according to the present invention comprises a first cutting station 10, shown in detail in FIGS. 3 and 4, which is designed to cut a fruit 100 into round portions 101 in parallel planes. As shown in FIG. 4, the first cutting station comprises a plurality of straight blades 11 arranged parallel to one another. These straight blades 11 are arranged vertically and are longitudinally mobile in an alternating straight motion by a motor mechanism not shown in detail since it is a device available to experts in the sector.

The first cutting station 10 also comprises a pusher 12 predisposed to push a fruit 100 into contact with the straight blades 11. Preferably, the pusher 12 includes a shoe 12*a* with a front surface intended to come into contact with a fruit 100. Such shoe is provided with a plurality of straight seats 12*b* destined to receive the straight blades 11 in such a way that the fruit 101 can be pushed by the pusher 12 to be traversed completely by the straight blades 11. In particular, the pusher 12 is movable between a first position, which is at a certain distance from the straight blades 11 and a fruit 100 can be positioned between the pusher 12 and the straight blades 11, and a second position, in which the straight blades are housed in the straight seats 12*b* and the front surface of the shoe 12 is located on the opposite side of the straight blades 11 with respect to the side it is on in the first position. During the stroke of the pusher 12 from the first position toward the second position, a fruit 101 positioned between the pusher 12 and the straight blades 11 first comes into contact with the blades themselves, and is gradually cut according to parallel cutting planes defined by the straight blades themselves. In the second position of the pusher 12, the fruit 101 has been completely traversed by the straight blades 11 and is divided into round portions 101.

A carousel 13 is predisposed to feed the fruits 100 in succession to the straight blades 11. The carousel 13 has at least two support elements 14 for at least two fruits 100. Each support element 14 is movable in rotation step by step, by the carousel 13, between at least one loading position, in which one fruit 100 can be placed on a support element 14, and a cutting position, where another fruit 100, placed on another support element 14, is located in an intermediate position between the pusher 12 and the straight blades 11 and can come in contact with the straight blades 11. In a preferred, but not exclusive, embodiment of the machine, the carousel 13 is equipped with four support elements 14 each separated by a regular angular pitch of 90°. For each step of rotation of the carousel 13, a support element 14 is in the load position and another support element 14 is in cutting position, in correspondence with which the fruit 100 placed on the support element 14 can be pushed, by the pusher 12, into contact with the straight blades 11. At each step of rotation of the carousel 13, a fruit 100 is then cut into round portions freeing the support element 14 on which the fruit is supported. Thus upon the next step of rotation, the support element 14 can be loaded with another fruit 100.

In the preferred embodiment of the machine, at the outlet of the first cutting station 10 there is a conveyor plane 15 upon which the round portions 101 can be placed, either by falling directly from the first cutting station 10, or by another device or by the intervention of an operator.

Figure 5:
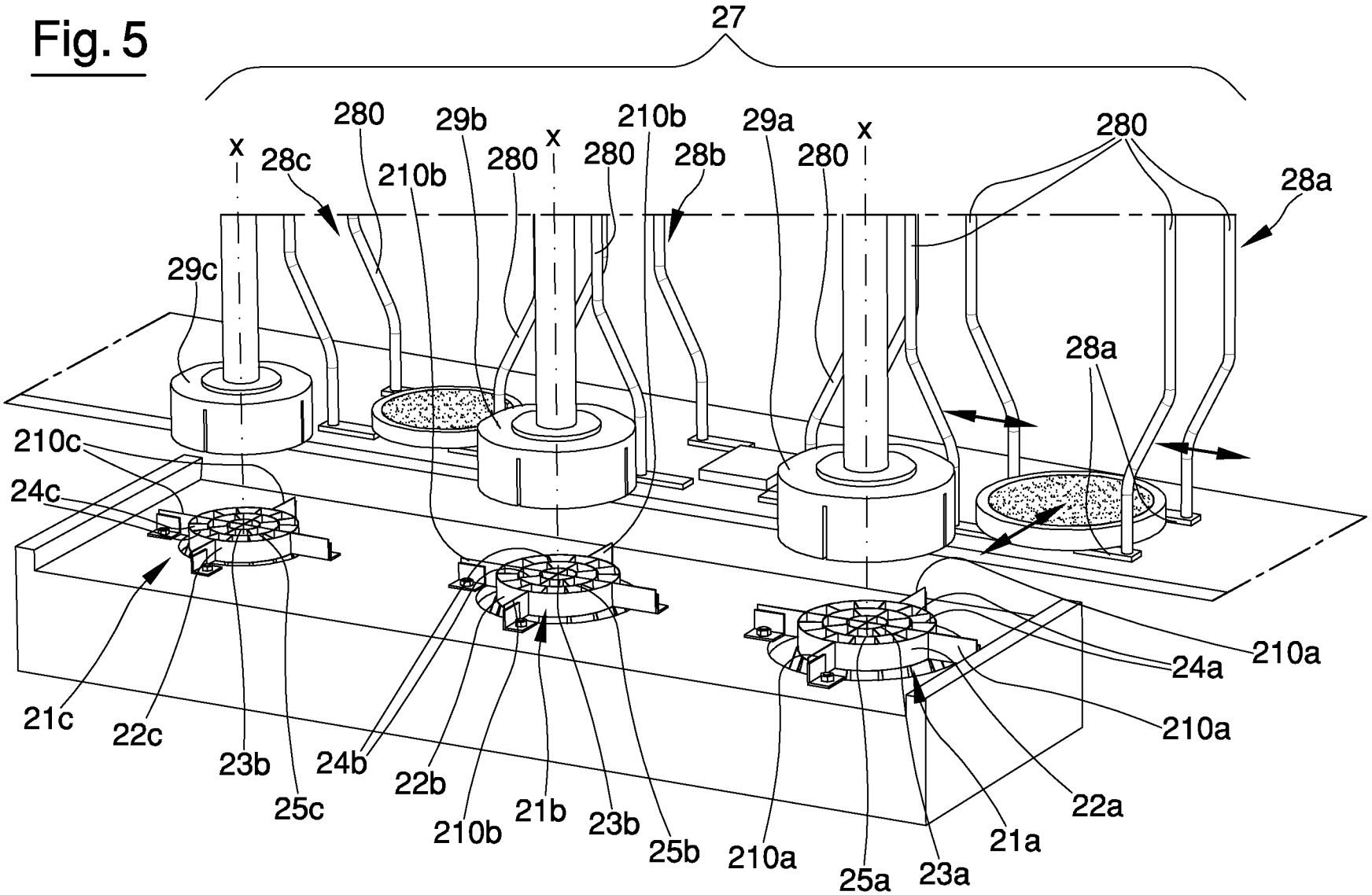
FIG. 5 shows a second cutting station of the first embodiment of the machine.
Figure 6:
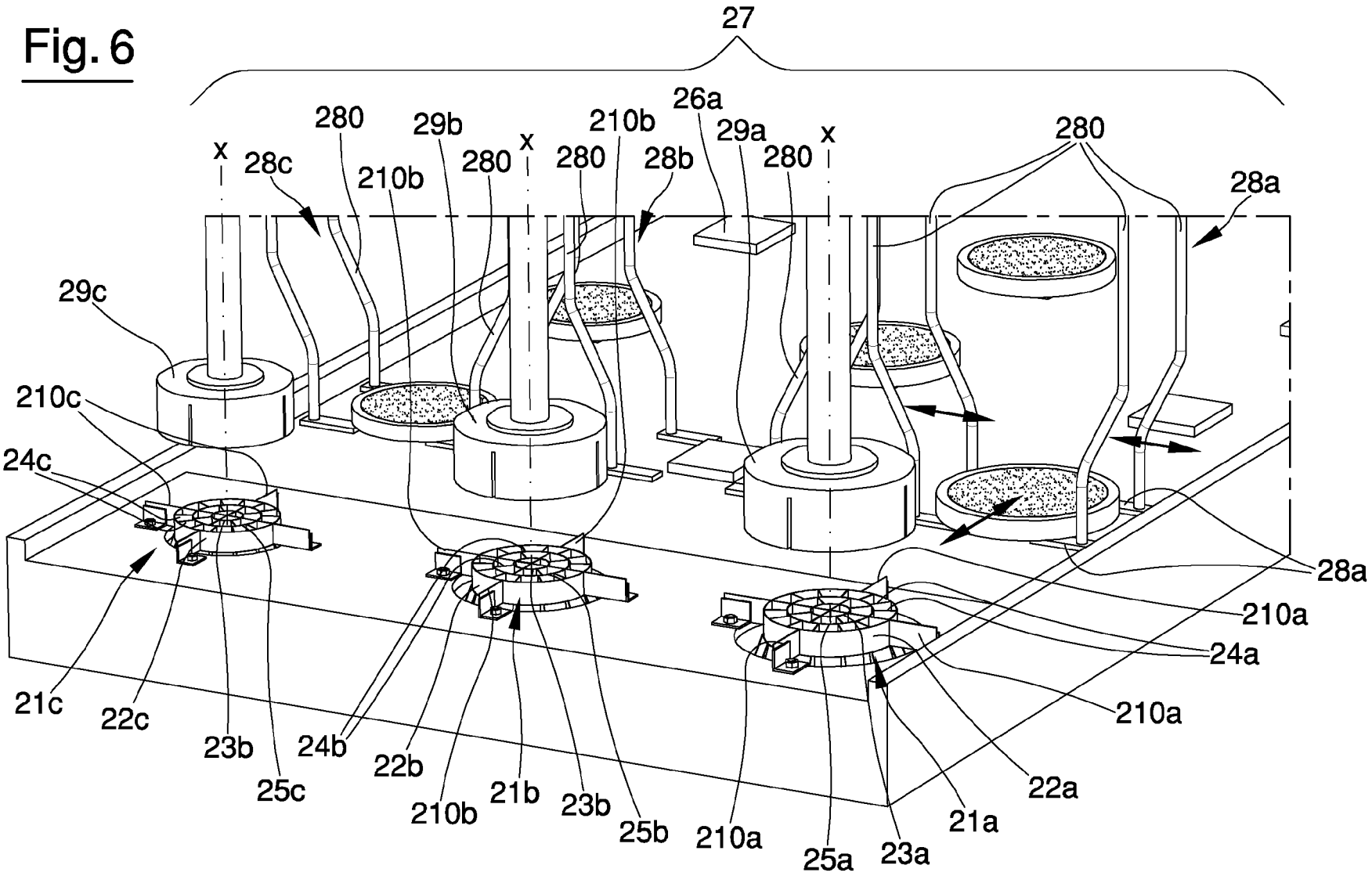
FIG. 6 shows a second cutting station of the second embodiment of the machine.

The machine according to the present invention comprises a second cutting station 20, shown in detail in FIGS. 5 and 6, which has two or more shaped blades 21*a,b,c* predisposed to cut the round portions 12 into prismatic fragments. Preferably, the cutting of the round portions 101 occurs according to at least one axially symmetric surface, that separates the rind 101*a* from the pulp 101*b*, and a plurality of radial planes containing the central axis of symmetry of the axially symmetric surface. To this end, the shaped blades 21*a,b,c* comprise at least one external cutter 22*a, b, c*, with an axially symmetric shape, predisposed to separate the rind 101*a* from the pulp 101*b* of a round portion. This external cutter 22*a,b,c* has a central axis of symmetry x. The shaped blades also comprise at least one internal cutter 23*a,b,c*, with an axially symmetric shape, concentric to the external cutter 22*a,b,c*. A plurality of radial cutters 24*a,b,c* are variously arranged between the inner and outer edges 22,23*a,b,c*. These radial cutters are preferably oriented in a substantially radial direction with respect to the axis of symmetry x. The arrangement and orientation of the radial cutters 24*a,b,c* described and illustrated, can in any case be changed at will depending on the desired shape and dimensions for the prismatic fragments obtained by from the round portions 101. As regards the external cutters 22*a,b,c* and internal cutters 23*a,b,c*, in a preferred embodiment, they are circular in shape, as shown in the accompanying figures. In an alternative embodiment, the external cutters 22*a,b,c* and internal cutters 23*a,b,c* could be constructed in a polygonal shape, which gives the prismatic fragments of fruit flat faces.

As seen in FIG. 5 and FIG. 6, the shaped blades 21*a,b,c* have different outer diameters from one another. In particular, the second cutting station 20 comprises three shaped blades. A first shaped blade 21*a* has a larger outer diameter, a second shaped blade 21*b* has an intermediate outer diameter and a third shaped blade 21*c* has a smaller outer diameter.

Figure 1:
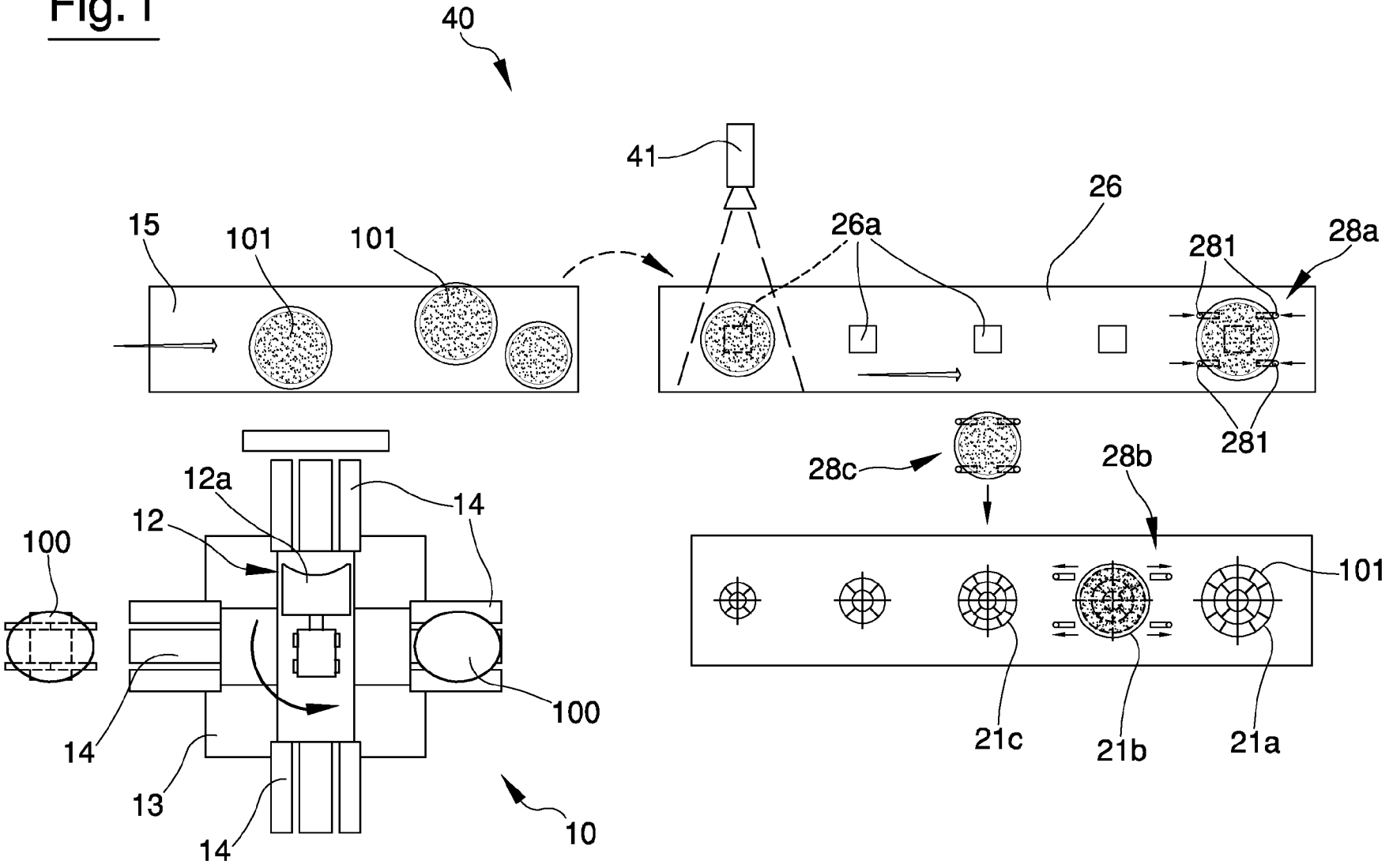
FIG. 1 shows a plan view drawing of a first embodiment of the machine according to the present invention.

The presence of shaped blades of different diameters is particularly useful to enable the cutting of round portions 101 of different diameters. It is clear that the round portions 101 cut from the central area of the fruit 100 have, by virtue of the oval or spherical shape of the fruit itself, an average diameter greater than round portions 101 cut from areas progressively farther from the central area of the fruit. The round portions 101 with a larger diameter may be cut by the first shaped blade 21*a*, the round portions 101 with a smaller diameter may be cut by the third shaped blade 21*c* and the round portions 101 with an intermediate diameter can be cut by the second shaped blade 21*b*. The use of shaped blades with different diameters can also limit the thickness of the pulp that remains attached to the rind, since, for each round portion, it is possible to choose the shaped blade that comes closest to the innermost layer of the rind. Although the embodiment illustrated foresees the use of three shaped blades 21*a,b,c*, the number of shaped blades may in any case be varied at will. A greater number of shaped blades further reduces the waste of pulp. A good compromise between the size and complexity of the machine and waste reduction is the use of five shaped blades, as shown in FIG. 1.

As shown in FIGS. 5 and 6, the shaped blades with a larger diameter, in particular the first shaped blade 21*a* and the second shaped blade 21*b* can be fitted with an intermediate cutter 25*a,b* concentric to the external cutter 22*a,b* and the internal cutter 23*a,b*. The predisposition of an intermediate cutter, or further intermediate cutters, enables the reduction of the size of the fragments of fruit cut from the round portions 101. The presence and number of intermediate cutters can be varied depending on the desired final size of the fragments of fruit.

As seen in FIGS. 5 and 6, for each shaped blade 21*a,b,c*, there is a punch 29*a,b,c*, predisposed to press the round portions 100 on the shaped blades 21*a,b,c*. Each punch 29*a,b,c* is cyclically movable between a raised position, in which it is at some distance from its shaped blade 21*a,b,c* and in which a round portion 101 can be positioned on the shaped blade 21*a,b,c*, and a lowered position, where the round portion 101 is pressed into contact with the shaped blade 21*a,b,c* in order to be cut it into fragments. To this end, each punch 29*a,b,c* is equipped, on a front surface intended to come into contact with the round portions 101, with seats adapted to its shaped blade in such a way as to accommodate at least part of the height of the shaped blade. In this way, the entire thickness of each round portion 101 can be pushed through the shaped blade 21*a,b,c*, on which it rests.

The shaped blades 21*a,b,c* are placed above an opening through which the fragments of fruit can fall into a container or another item or means of transportation. Four vertical cutting elements 210*a,b,c*, aligned two by two according to orthogonal planes are arranged on the outside of each shaped blade 21*a,b,c* to split the rind into four pieces that can subsequently be discarded. In the absence of the four vertical cutting elements 210*a,b,c*, the rind of each round portion 101 would remain in an annular shape making it more difficult to manage.

The second cutting station 20 also comprises a mobile conveyor plane 26 with a step by step forward motion predisposed to feed the round portions 101 on the shaped blades 21*a,b,c*. Preferably such conveyor plane 26 has a plurality of support bases 26*a* to directly support the round portions 101. In a first embodiment of the machine, the support bases 26*a* are aligned along the feed direction of the conveyor plane 26, separated by a pitch equal to the feed pitch of the conveyor plane 26. The round portions 101 may be transferred from the first cutting station 10 to the conveyor plane 26 either by means of an automatic device, or, preferably, by a worker who picks up the round portions 101 from the conveyor plane 15 of the first cutting station and places them on the support bases 26*a*. The use of one person enables the direct examination of each round portion 101, so that the round portions 101 of unsuitable quality can be discarded directly.

The machine according to the present invention also comprises a sorting device 40, predisposed to detect a diameter of the round portions 101 and direct each round portion to a shaped blade 21*a,b,c*, selected according to the diameter of each round portion 101. As mentioned previously, the round portions 101, due to the shape of the fruit, have different diameters. The sorting device can direct each round portion 101 to the most appropriate shaped blade 21*a,b,c*, or rather to the shaped blade whose outer diameter is closest to the measured diameter of the round portion, which preferably is the diameter of the pulp.

To this end, the sorting device 40 comprises an optical detection device 41 predisposed to capture an image of the round portions 101 and to perform a measurement of the diameter of each round portion. The measurement may refer, for example, to the outer diameter of the round portion 101 relative to the face of the round portion facing upwards. Alternatively, using an optical detection device, the measurement may refer to the minimum diameter of the part to be discarded, composed of the rind and a layer adjacent to it, or to the maximum diameter of just the pulp.

A processor is predisposed to manage the detections made by the optical detection device 41 so as to group the detections themselves into determined size ranges, each of which is associated with a particular shaped blade 21*a,b,c*. In a preferred embodiment, the optical detection device 41 is predisposed to perform several detections in succession each of which refers to a determined size range. When the processor identifies a match between the detection made and a certain range, the appropriate shaped blade 21*a,b,c* is selected and the round portion 101 is sent to it.

In the preferred embodiment of the machine, the shaped blades 21*a,b,c* are aligned parallel to the conveyor plane 26 of the second cutting station 20 and are located next to the conveyor plane 26 itself. The support bases are spaced apart by the same pitch that separates the shaped blades 21*a,b,c*. This allows for a support base 26*a* to be placed at the side of a shaped blade 21*a,b,c* in the stop positions for each forward pitch of the conveyor plane 26.

As already mentioned, each shaped blade 21*a,b,c* is associated with a certain range of size values. Each range of size values is associated in turn with one of the detections made in succession by the optical detection device 41. To simplify the control carried out by the processor of the sorting device 40 and to enable greater productivity of the machine, the shaped blades 21*a,b,c* are preferably arranged in a progressive order of size. For example, a first larger shaped blade 21*a* can be placed in the farthest position from the optical detection device 41, while the other shaped blades 21*b,c* are placed at progressively smaller distances. The minimum distance between one shaped blade and the optical detection device 41 is equal to one movement forward of the conveyor plane 26.

In correspondence to the orderly arrangement of the blades 21*a,b,c*, even the detections carried out by the detection device 41 are made in the ordered sequence of ranges of values associated with the blades 21*a,b,c*.

The processor of the sorting device 40 is predisposed to know the position of each support base 26*a* of the conveyor plane 26. Since the support bases 26 are spaced apart with a regular pitch corresponding to the forward pitch of the conveyor plane 26, note the position of a first support base 26*a* at the initial start up of the machine and it is possible to know the position of that first support base 26*a*, and all other support bases 26*a*, by simply counting the number of forward pitches the conveyor plane 26 has taken, for example by means of an encoder. In this way, when the machine is fully operational and each support base 26*a* is occupied by a round portion 101, the processor is able to know the position and the range of size values of each round portion 101 downstream of the detection device 41. This enables the processor to determine at each forward pitch of the conveyor plane 26 if a round portion 101 is located next to the shaped blade 21*a,b,c* corresponding to the range of size values that has been detected for it by the detection device 41.

The operation of the conveyor plane 26 is coordinated with the detections carried out by the detection device as follows. In an initial operating condition in which the conveyor plane 26 is stopped, a first round portion 101 positioned on a first support base 26*a* of the conveyor plane 26 is at the detection device 41. The processor assigns a starting position to this first support base 26*a* and the detection device 41 performs a first detection associated with the range of values corresponding to the largest shaped blade 21*a*. If the detection of the round portion 101 shows a size that falls in the range of values corresponding to the largest shaped blade 21*a*, the processor associates that range of size values to the first support base 26*a*. If, however, the detection does not fall within the range of values corresponding to the largest shaped blade 21*a*, then a second detection is taken associated with the range of values associated with the smaller shaped blade 21*b*. If the detection is positive, then the processor associates that range of smaller size values to the first support base 26*a*. If the detection is negative, a third measurement is conducted, and so on for the number of shaped blades present.

Once there is a positive detection of a round portion 101, or rather where the size detected for a round portion 101 corresponds to the range of size values associated with the detection conducted, the processor is able to know where the support base 26*a* is with the round portion 101 itself through the simple count of the forward pitches made by the conveyor plane 26. This is true of course for every support base 26*a* that, following the first, stops at the detection device 41.

A positioning device 27 is predisposed to collect the round portions 101 from the conveyor plane 26 and to place the round portions 101 on the shaped blades 21*a,b,c*. This positioning device 27 comprises, for each shaped blade 21*a,b,c*, a shifter 28*a,b,c* equipped with gripping elements 280 that can be, for example, in the shape of plates or a group of fingers. The gripping elements 280 are predisposed to fit beneath the round portions 101, in a space defined by the support bases 26*a* between the conveyor plane 26 and the round portions 101 above. The gripping elements 280 are arranged above the conveyor plane 26 and project downwards. The gripping elements 280, if realized in the form of fingers, are equipped with appendages 281 at their lower ends predisposed in order to be inserted under the round portions 101 arranged on the support bases 26*a*.

Each shifter 28*a,b,c* is movable between a gripping position, in which it is located above the conveyor plane 26, and a release position, in which it is above its shaped blade 21*a,b,c*. The gripping elements 280 of each shifter 28*a,b,c* are mobile approaching and moving away from one another from a narrow closed position, in which they can be arranged below a round portion 101, and a wide position in which they release the round portion 101. In FIG. 5 and FIG. 6 the gripping elements 280 are depicted in wide gripping position and narrow closed position. FIG. 1 shows the other positions of the shifters 28*a,b,c*: a first shifter 28*a* is shown in gripping position, a second shifter 28*b* is shown in release position, and a third shifter 28*c* is in an intermediate position while taking a round portion 101 from the conveyor plane 26 to the corresponding shaped blade 28*c*.

The operation of the conveyor plane 26 and the positioning device 27 occurs in the manner described below. The conveyor plane 26 slides with a forward step motion. At full capacity, at each stop of the conveyor plane 26, each shaped blade 21*a,b,c* has a support base 26*a* next to it. In the event that a support base 26*a* is bearing a round portion with dimensions that fall within the range of size values associated with the shaped blade it is next to in that moment, the shifter corresponding to that shaped blade is activated and the round portion 101 is transferred from the conveyor plane to the shaped blade 26. If, however, the size of the round portion does not fall within the range, the shifter is not activated and the round portion 101 continues to the next step, and so on for each forward pitch of the conveyor plane 26. If the detections carried out on a round portion do not correspond to any of the shaped blades, no shifter is activated to move the round portion and the round portion passes through the conveyor plane 26 until the end where it is discarded. During each pause cycle of the conveyor plane 26, following the deposit of the round portions 101 on the shaped blades 21*a,b,c*, the punches 29*a,b,c*, move from the raised position to the lowered position to cut the round portions. To simplify the management of the machine, the punches do their cycle of movement from the raised position to the lowered position and back stopping at every stop of the conveyor plane 26, regardless of the presence or absence of a round portion 101 on the corresponding shaped blade. Having a presence sensor at each shaped blade makes it possible to subordinate the action of each punch to the actual presence of a round portion 101.

The pattern of movement of each shifter 28*a,b,c* starts from the release position. In the presence of activation command the shifter moves to the gripping position with the gripping elements 280 in a wide position. Subsequently, the gripping elements clasp together in the narrow closed position, grasping the round portion 101 as well, and the shifter moves to the release position above the shaped blade. When the shifter is in the release position, the gripping elements are brought to the wide position, depositing the round portion 101 on the shaped blade 21*a,b,c*. The operational steps described are repeated cyclically during the operation of the machine.

Figure 2:
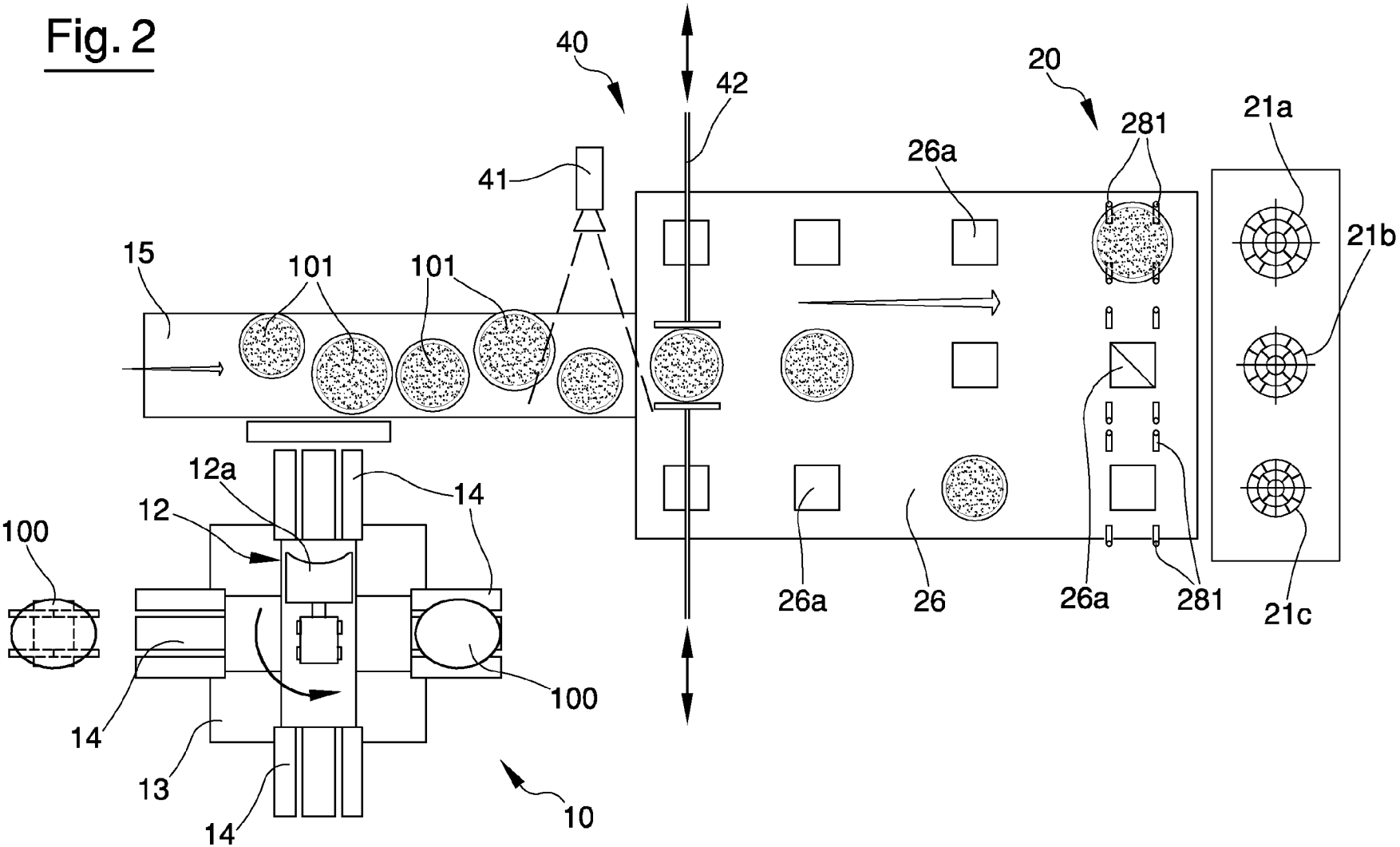
FIG. 2 shows a plan view drawing of a second embodiment of the machine according to the present invention.

In an alternative embodiment of the machine, illustrated in FIGS. 2 and 6, the support bases 26*a* are distributed in parallel rows each one aligned with one of the shaped blades 21*a,b,c*. The shaped blades 21*a,b,c* are at the output end of the conveyor plane 26 placed side by side and aligned transversely to the feed direction of the conveyor plane 26.

In this alternative embodiment, the sorting device 40 comprises an diverter element 42*a* that is movable in a transverse direction with respect to the feed direction of the conveyor plane 26 of the second cutting station 20. This diverter element 42*a* is predisposed to move the round portions 101, coming from the conveyor plane 15 of the output of the first cutting station, in a transverse direction with respect to the direction of the conveyor plane 26 of the second cutting station 20, in such a way as to align each round portion 101 with the shaped blade to which it was assigned. In this way, by means of the conveyor plane 15 and the sorting device 40, an automatic transfer device between the first cutting station 10 and the second cutting station 20 is defined. This automatic transfer device independently directs the round portions 101 toward the most appropriate shaped blade 21*a,b,c* for cutting.

The shifters 28*a,b,c*, in this alternative embodiment, are movable in a direction parallel to the feed direction of the conveyor plane 26. During each stop of the conveyor plane 26 each shifter 28*a,b,c*, which is in its gripping position with the fingers in a wide position, is driven to bring the gripping elements 280 into the narrow closed position to pick up a round portion 101, if present on the respective support base 26*a*. Then each shifter moves towards the release position while the conveyor plane 26 is simultaneously activated to move a further step forward. Once in the release position, the gripping elements 280 of each shifter 28*a,b,c* are activated into their wide position in which the round portion 101, if it has been grasped, can be placed on a shaped blade 21*a,b,c*. Subsequently, the punches 29*a,b,c* perform their cycle of movement from the raised position to the lowered position and back to the raised position. The operational steps described are repeated cyclically during operation of the machine. Since, in this alternative embodiment of the machine, the round portions 101 travel along parallel lines and can reach the intended shaped blade 21*a,b,c* without interfering with the round portions 101 allocated to other shaped blades, it is not necessary for the processor of the sorting device 40, to know the position of the round portions 101 along the feed direction of the conveyor plane 26. Once each round portion 101 has been directed towards the right shaped blade 21*a,b,c*, no further control by the processor is required. The processor's control ends with the control of the diverter element 42*a*.

The machine according to the present invention effectively achieves the intended objectives. In fact it enables the preparation of pieces from an oval or spherical fruit in a substantially automated way, limiting the use of operators to loading the fruit on the first cutting station and, possibly, for the simple transfer of round portions from the sorting device 40 to the conveyor plane 26 of the second cutting station. The cutting of fruit first into round portions 101 and then into prismatic pieces is particularly effective and considerably reduces the waste of pulp. The special shape of the shaped blades 21*a,b,c* enables the round portions 101 to be cut into well proportioned and regular prismatic pieces. The presence of multiple shaped blades 21*a,b,c*, enables the waste of pulp to be limited.

The invention claimed is:

1. A machine for preparing pieces of an oval or spherical fruit, comprising: a first cutting station (10), predisposed for cutting a fruit (100) into round portions (101) in parallel planes; a second cutting station (20), provided with two or more shaped blades (21*a,b,c*) predisposed for cutting said round portions (101) into prismatic fragments; an optical detection device (41) predisposed for acquiring an image of the round portions (101) and for performing a measurement of a size of each round portion; a processor, predisposed for comparing the measurements with a plurality of stored size ranges, each of which is associated with a shaped blade (21*a, b, c*) and for sending each round portion (101) to the shaped blade (21*a, b, c*) associated with the size range in which the measured round portion (101) falls within;

wherein: the second cutting station (20) comprises a conveyor plane (26) that is mobile with a step by step motion along a forward direction (A) wherein each step is a forward pitch; the processor is predisposed to count forward pitches of the conveyor plane (26) for each round portion (101);

the machine comprising a positioning device (27), predisposed to collect the round portions (101) from the conveyor plane (26) and to deposit each round portion (101) on the shaped blade (21*a,b,c*) associated with the size range in which the measured round portion falls within.

2. The machine of claim 1, wherein said optical detection device (41) is predisposed to perform, on each round portion (101), a plurality of successive measurements, each of which is compared with the stored size ranges, and to terminate the successive measurements at a moment in which a match is detected between a measured round portion and one of the stored size ranges.

3. The machine of claim 2, wherein the comparison performed by the processor occurs among the measured round portion (101) and the stored size ranges of the shaped blades in progressive order.

4. The machine of claim 1, wherein: the positioning device (27) comprises a shifter (28*a,b,c*) for each shaped blade (21*a, b,c*); each shifter (28*a,b,c*) is predisposed for collecting a round portion (101) from the conveyor plane (26) and for depositing the round portion (101) on a shaped blade (21*a,b, c*) arranged at the shifter; the activation of each shifter (28*a, b,c*) is actuated if the round portion (101) which is at the shifter exhibits a size that falls within the size range associated with the shaped blade (21*a,b,c*) arranged at the shifter.

5. The machine of claim 1, wherein the shaped blades (21*a,b,c*) are arranged aligned parallel to the conveyor plane (26) by a side of the conveyor plane (26).

6. The machine of claim 1, wherein the shaped blades (21*a,b,c*) are positioned at an output end of the conveyor plane (26) placed side by side and aligned transversely to the forward direction of the conveyor plane (26).

7. The machine of claim 1, wherein said first cutting station (10) comprises a plurality of straight blades (11) arranged parallel to one another.

8. The machine of claim 7, wherein said straight blades (11) are longitudinally mobile in an alternating straight motion.

9. The machine of claim 8, wherein said first cutting station (10) comprises a pusher (12) predisposed to push the fruit (100) into contact with said straight blades (11).

10. The machine of claim 7, wherein said first cutting station (10) comprises a pusher (12) predisposed to push the fruit (100) into contact with said straight blades (11).

11. The machine of claim 7, wherein said first cutting station (10) comprises a carousel (13) provided with support elements (14) for at least two fruits (100), said support elements (14) being mobile in stepped rotation, performed by said carousel (13), between at least a loading position, in which a fruit (100) can be located on a support element (14), and a cutting position, in which a further fruit (100), located on a further support element (14), can enter into contact with said straight blades (11).

12. The machine of claim 11, wherein said further fruit (100), located on said further support element (14), can enter into contact with said straight blades (11) to be cut into round portions (101).

13. The machine of claim 1, wherein said shaped blades (21*a,b,c*) of the second cutting station (20) comprise: at least an external cutter (22*a,b,c*) predisposed for separating a peel from a pulp of a round portion (101), which exhibits a central axis of symmetry (x); at least an internal cutter (23*a,b,c*), concentric to the external cutter (22*a,b,c*); a plurality of radial cutters (24*a,b,c*), arranged between said internal and external cutters and orientated in a substantially radial direction with respect to the central axis of symmetry (x).

14. The machine of claim 13, wherein said shaped blades (21*a,b,c*) exhibit external diameters which are different from one another.

15. The machine of claim 1, wherein a punch (29*a,b,c*) is provided for each shaped blade (21*a,b,c*), which punch is predisposed to press the round portions (101) on the shaped blades (21*a,b,c*) such that the round portions are cut into prismatic fragments by the shaped blades (21*a,b,c*).

16. The machine of claim 1, wherein said oval or spherical fruit is a watermelon or a melon.

* * * * *